US011085688B2

(12) United States Patent
Seo et al.

(10) Patent No.: US 11,085,688 B2
(45) Date of Patent: Aug. 10, 2021

(54) MODIFIED DRY ICE SYSTEMS AND METHODS FOR PRESERVING PERISHABLE ITEMS WITHIN A SINGLE HOLDING VOLUME

(71) Applicants: Chang Yup Seo, Woodridge, IL (US); Soujanya N Jampala, Chicago, IL (US); Sameer H Israni, Darien, IL (US); Robert R Sever, Arlington Heights, IL (US)

(72) Inventors: Chang Yup Seo, Woodridge, IL (US); Soujanya N Jampala, Chicago, IL (US); Sameer H Israni, Darien, IL (US); Robert R Sever, Arlington Heights, IL (US)

(73) Assignee: Praxair Technology, Inc., Danbury, CT (US)

( * ) Notice: Subject to any disclaimer, the term of this patent is extended or adjusted under 35 U.S.C. 154(b) by 177 days.

(21) Appl. No.: 16/550,740

(22) Filed: Aug. 26, 2019

(65) Prior Publication Data

US 2020/0072523 A1 Mar. 5, 2020

Related U.S. Application Data

(60) Provisional application No. 62/724,331, filed on Aug. 29, 2018.

(51) Int. Cl.

| | |
|---|---|
| ***F25D 3/12*** | (2006.01) |
| *B65D 81/18* | (2006.01) |
| *B65D 81/38* | (2006.01) |

(52) U.S. Cl.
CPC ..... *F25D 3/125* (2013.01); *B65D 81/18* (2013.01); *B65D 81/3825* (2013.01)

(58) Field of Classification Search
CPC ..... F25D 3/125; F25D 3/06; F25D 2303/082; F25D 2303/0844; F25D 2303/0845; B65D 81/18; B65D 81/3825
See application file for complete search history.

(56) References Cited

U.S. PATENT DOCUMENTS

| | | | | |
|---|---|---|---|---|
| 4,294,079 | A | 10/1981 | Benson | |
| 6,457,323 | B1 * | 10/2002 | Marotta | B65D 25/06 62/371 |
| 6,482,332 | B1 * | 11/2002 | Malach | C09K 5/066 165/10 |

(Continued)

FOREIGN PATENT DOCUMENTS

| | | | | |
|---|---|---|---|---|
| FR | 2954295 | A1 | 6/2011 | |
| JP | 2007118972 | A * | 5/2007 | F25D 3/08 |

(Continued)

*Primary Examiner* — Emmanuel E Duke
(74) *Attorney, Agent, or Firm* — Nilay S. Dalal

(57) ABSTRACT

This invention relates to a novel two-stage dry ice system for preserving perishable items during transport and methods thereof. The improved two-stage dry ice system includes dry ice and a phase change material specifically configured within a single and continuous holding volume with perishable items. Preservation of the perishable items for extended durations in comparison to other refrigeration techniques can be achieved as a result of the two-stage dry system having the ability to re-orient itself during transport.

33 Claims, 5 Drawing Sheets

(56) References Cited

U.S. PATENT DOCUMENTS

| | | | | |
|---|---|---|---|---|
| 2006/0191282 | A1* | 8/2006 | Sekiya | B65D 79/02 62/371 |
| 2010/0064698 | A1* | 3/2010 | Schabron | F25D 3/08 62/62 |
| 2014/0021208 | A1* | 1/2014 | Anti | A01N 1/0273 220/592.25 |
| 2014/0174692 | A1* | 6/2014 | Emond | F28F 13/00 165/47 |
| 2017/0350635 | A1* | 12/2017 | Thirumurugavel | G06Q 10/0832 |

FOREIGN PATENT DOCUMENTS

| | | | |
|---|---|---|---|
| KR | 20110124823 | A | 11/2011 |
| WO | 2007049380 | A1 | 5/2007 |

* cited by examiner

MODIFIED DRY ICE SYSTEMS AND METHODS FOR PRESERVING PERISHABLE ITEMS WITHIN A SINGLE HOLDING VOLUME

RELATED APPLICATIONS

The present application claims the benefit of priority to U.S. Application Ser. No. 62/724,331, filed Aug. 29, 2018, which is hereby incorporated by reference in its entirety for all purposes.

FIELD OF INVENTION

This invention relates to preserving perishable items by utilizing a two-stage refrigeration system.

BACKGROUND OF THE INVENTION

The transport of materials can require a so-called "cold chain" to preserve their quality. The expression "cold chain" as used herein and throughout is intended to describe a supply chain that maintains the material in a preferred temperature range during its production, distribution and/or storage.

The need for effective cold chains is applicable to a wide variety of items. One type of cold chain pertains to food delivery to consumer homes. Cold chains for food home delivery often involve perishable foods. Examples of perishable foods include, but are not limited to, meat, poultry, fish, fruits, vegetables, and dairy products. The majority of such perishable foods which are purchased online require food home delivery. The continual increase of online food purchases has contributed to significant growth of food home delivery.

The main cold chain temperature regimes for food home delivery are refrigerated and frozen. A refrigerated cold chain typically maintains the food below ambient temperature but above its freezing point; refrigerated temperatures are often in the range of 2–8° C. (36-46° F.). A frozen cold chain typically maintains the food below its freezing point; a common specification for food products is below −15° C. (5° F.). Sometimes, frozen food items are shipped in a refrigerated temperature regime that permits the food to partially or fully thaw in transit but not warm above a critical temperature threshold.

The delivery of perishable foods may require a container with a coolant that maintains a temperature below a specified temperature to prevent spoilage. In many instances, different perishable foods in a customer order require different amounts of cooling. For example, an order from a grocery store may include dairy products and poultry, each of which require different cooling temperature regimes. In some instances, delivery companies ship the perishable food requiring different preservation temperatures by utilizing separate containers, each of which has their own coolant. In this manner, each container is maintained at a different cooling temperature regime corresponding to the type of perishable food being shipped.

Alternatively, different compartmentalized temperature zones in the same container have been used to store and transport perishable foods having different cooling temperature requirements. However, such compartmentalized containers may not exhibit the desired temperature control nor be capable of preserving different types of perishable items for an extended duration of transport.

In view of these drawbacks, there is an unmet need for improved refrigeration techniques for preserving materials within a container during storage and transport.

SUMMARY OF THE INVENTION

In one aspect, an improved two-stage dry ice system for preserving a first perishable item and a second perishable item during transport of the first perishable item and the second perishable item, said improved two-stage dry ice system, comprising: a transportable container with a holding volume defined by a first region and a second region, said first region containing the first perishable item and maintaining the first perishable item at a first cooling temperature regime, said second region containing the second perishable item and maintaining the second perishable item at a second cooling temperature regime; a phase change material (PCM) in close proximity or direct contact to the first perishable item, the PCM disposed within the first region of the holding volume prior to transport; dry ice in close proximity or direct contact with the second perishable item, said dry ice disposed within the second region of the holding volume prior to transport; insulative material configured to partially encapsulate the second perishable item during transport of the transportable container; wherein the PCM and the dry ice form a substantially stacked arrangement with the first perishable item and the second perishable item, said PCM configured to interact with the dry ice in the stacked arrangement whereby the dry ice serves as a first primary refrigerant to maintain the first cooling temperature regime and the second cooling temperature regime during an initial duration of the transport of the transportable container, subsequently followed by the PCM acting as a second primary refrigerant to maintain the first cooling temperature regime and the second cooling temperature regime during a final duration of the transport of the transportable container.

In a second aspect, an improved two-stage dry ice system for preserving a first perishable item and a second perishable item during transport of the first perishable item and the second perishable item, said improved two-stage dry ice system, comprising: a transportable container with a holding volume defined by a first region and a second region, said first region containing the first perishable item and maintaining the first perishable item at a first cooling temperature regime, said second region containing the second perishable item and maintaining the second perishable item at a second cooling temperature regime, the holding volume further defined by an absence of partitions or compartments therewithin; one or more gel packs (GPs) substantially comprised of water in a partially or fully thawed state in close proximity or direct contact to the first perishable item, the one or more GPs disposed within the first region of the holding volume prior to transport; dry ice in close proximity or direct contact with the second perishable item, said dry ice disposed within the second region of the holding volume prior to transport and during an initial duration of the transport; insulative material configured to extend along a portion of the second perishable item; wherein the GP and the dry ice form a substantially stacked arrangement with the first perishable item and the second perishable item.

In a third aspect, a method of constructing a two-staged dry ice system for preserving a first perishable item in a first region of a holding volume at a first temperature regime and a second perishable item in a second region of the holding volume at a second temperature regime lower than the first temperature regime for an extended duration in comparison to conventional refrigeration techniques, comprising: selecting dry ice with a predetermined weight and density, said predetermined weight greater than a lower limit so as to achieve the extended duration but no greater than an upper limit that imparts excess cooling to the first perishable item so as to attain a temperature below the first temperature regime; selecting one or more gel packs (GPs) substantially comprised of water in a partially or fully thawed state with a total predetermined weight; loading and stacking the first perishable item to be in close proximity or direct contact with the one or more GPs within the holding volume so as to create the first region; loading and stacking the second perishable item in close proximity or direct contact with the dry ice within the holding volume so as to create the second region adjacent to the first region; wherein the dry ice and said one or more GPs are configured in a stacked arrangement whereby the dry ice serves as a first primary refrigerant to provide a requisite cooling to preserve the first and the second perishables during the initial duration of the transport of the transportable container as the one or more GPs protects the first perishable item from falling below the first temperature regime and thereby damaging the first perishable item, subsequently followed by the one or more GPs serving as a second primary refrigerant to provide the requisite cooling to preserve the first and the second perishables during a final duration of the transport of the transportable container.

In a fourth aspect, a method of preserving a first perishable item in a first region of a holding volume at a first temperature and a second perishable item in a second region of the holding volume at a second temperature lower than the first temperature for an extended duration in comparison to conventional refrigeration techniques, comprising: initiating a first stage of cooling by imparting a necessary amount of first-stage refrigeration to each of the first perishable item and the second perishable item from a dry ice source that is in close proximity or direct contact to the second perishable item; storing and suppressing the amount of refrigeration imparted from the dry ice source to the first perishable during the first stage of cooling so as to prevent damage to the first perishable items using one or more gel packs (GPs) substantially comprised of water in a partially or fully thawed state that are in close proximity or direct contact to the first perishable item; partially or completely freezing the GPs during the first stage refrigeration to create a partially or fully frozen GPs with sufficient refrigeration capacity; vaporizing substantially all of the dry ice within the holding volume; and shifting from the first stage of cooling to a second stage of cooling by imparting a necessary amount of a second-stage refrigeration to each of the first perishable item and the second perishable item provided from the partially or fully frozen GPs.

In a fifth aspect, an improved two-stage dry ice system for preserving a first perishable item during transport of the first perishable item, said improved two-stage dry ice system, comprising: a transportable container with a holding volume, said holding volume containing the first perishable and maintaining the first perishable item at a first cooling temperature regime; a phase change material (PCM) in the holding volume, said PCM between a first surface of the first perishable item and a second surface of a predetermined amount of dry ice, said dry ice at a lower temperature than the PCM; wherein the PCM and the dry ice form a substantially stacked arrangement with the first perishable item, said PCM configured to interact with the dry ice in the stacked arrangement whereby the dry ice serves as a first primary refrigerant to maintain the first cooling temperature regime during an initial duration of the transport of the transportable container, subsequently followed by the PCM serving as a second primary refrigerant for maintaining the first cooling temperature regime during a final duration of the transport of the transportable container.

DETAILED DESCRIPTION OF THE INVENTION

Figure 1A:
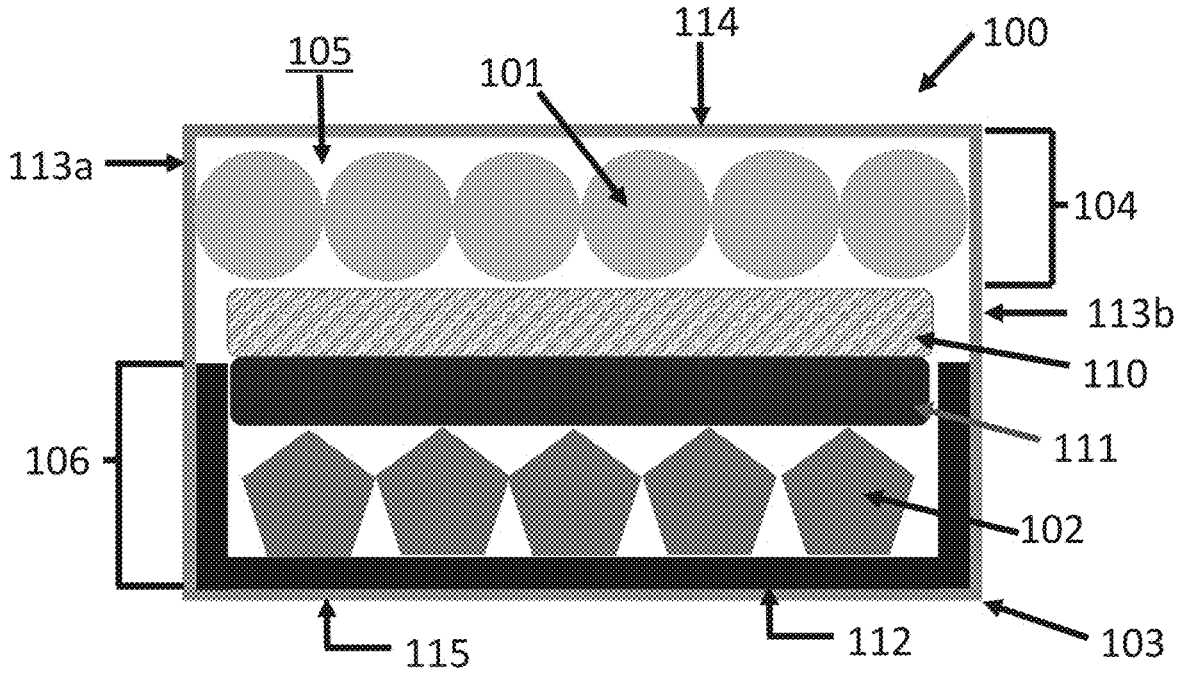
FIG. 1*a* illustrates a phase change material ("PCM") and dry ice in a stacked arrangement with a first perishable item and a second perishable item as part of a two-stage dry ice system after preparation of the container and prior to transport in accordance with the principles of the present invention.

As will be described, in one aspect, the present invention offers a system and method for preserving perishable items in a single holding volume of a container. While the present invention can be used with any "item" as defined herein below, in a preferred embodiment, the present invention is especially conducive for maintaining compliance with the food packaging protocols required to reliably preserve refrigerated and/or frozen food items. The use of a novel two-stage dry ice system specifically arranged with the perishable food items can allow preservation of the perishable food items for an extended duration in comparison to other refrigerated configurations.

"Close proximity" as used herein and throughout means indirect contact between the refrigerant and a perishable item such that the refrigerant can maintain the perishable item within its required cooling temperature regime in the presence of a material situated between the refrigerant and the perishable item that does not significantly impact the heat transfer between the refrigerant and perishable item. Examples of such materials include relatively thin cardboard sheet or plastic liner or other suitable materials.

It should be understood that the term "dry ice" as used herein and throughout can include solidified CO2 in any form, including but not limited to slab form of any size, shape and density, or the form of particles, nuggets or flakes of any size and shape.

The term "item" as used herein and throughout means any temperature-sensitive goods, products or supplies which may be susceptible to spoilage, degradation, and/or structural alteration or modification if not maintained within a certain cooling temperature regime, including, but not limited to, perishable foods, such as meat, poultry, fish, dairy products and produce. It should be understood "items" can also include non-food items, such as chemicals, pharmaceuticals, and personal care items.

"Container" as used herein and throughout means an enclosed structure having a defined holding volume into which items are placed. Examples of containers include, but are not limited to cardboard boxes, which are suitable for production, storage and/or transport of items.

The term "refrigeration" as used herein and throughout is intended to mean the cooling requirements provided by a refrigeration source (i.e., "refrigerant") to preserve items, including perishable items, with certain cooling requirements. Examples of refrigeration sources include dry ice and phase change materials.

It should be understood that the temperatures described herein are intended to mean a temperature at a particular location as opposed to an average temperature, unless specified otherwise. For example, the "first cooling temperature" or the "first cooling temperature regime" is intended to mean the temperature at a particular location along the first perishable item.

The term "thawed" means a material that is at least partially above its freezing point.

"Transportable" designates that an apparatus, such as a container, is capable of being moved, transported or shipped from an initial location to an intermediate or final location by any known means, including, but not limited to, air, ground or water. By way of example, the transport or shipping can occur through various packaged delivery services, including, but not limited to, parcel post, UPS® shipping services, FedEx® shipping services and the like.

As used herein and throughout, "about" or "approximately" when referring to a measurable value such as an amount or a temporal duration is meant to encompass variations of ±20%, ±10%, ±5%, ±1% and ±0.1% from the specified value, as such variations are appropriate.

Throughout this disclosure, various aspects of the invention can be presented in range format. It should be understood that the description in range format is merely for convenience and brevity and should not be considered as a limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, 6 and any whole and partial increments therebetween. This applies regardless of the breadth of the range.

The embodiments as described below are by way of example only, and the invention is not limited to the embodiments illustrated in the drawings. It should also be understood that the drawings are not to scale and in certain instances details have been omitted, which are not necessary for an understanding of the embodiments.

The embodiments are described with reference to the drawings in which similar elements are referred to by like numerals. The relationship and functioning of the various elements of the embodiments are better understood by the following detailed description. The detailed description contemplates the features, aspects and embodiments in various permutations and combinations, as being within the scope of the disclosure. The disclosure may therefore be specified as comprising, consisting of or consisting essentially of, any of such combinations and permutations of these specific features, aspects, and embodiments, or a selected one or ones thereof.

Figure 1B:
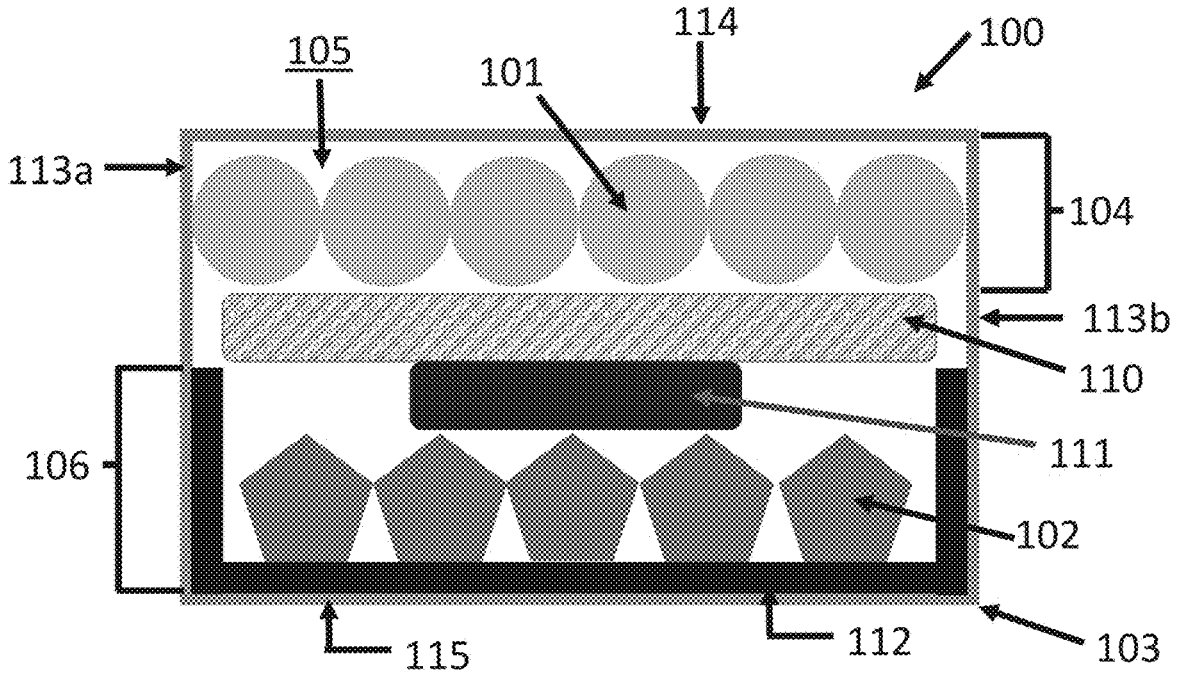
FIG. 1*b* illustrates the stacked arrangement of FIG. 1*a* during an initial duration of the transport in which the dry ice serves as the primary refrigerant to maintain the required cooling temperature regimes of the first perishable item and the second perishable item, respectively, in accordance with the principles of the present invention.
Figure 1C:
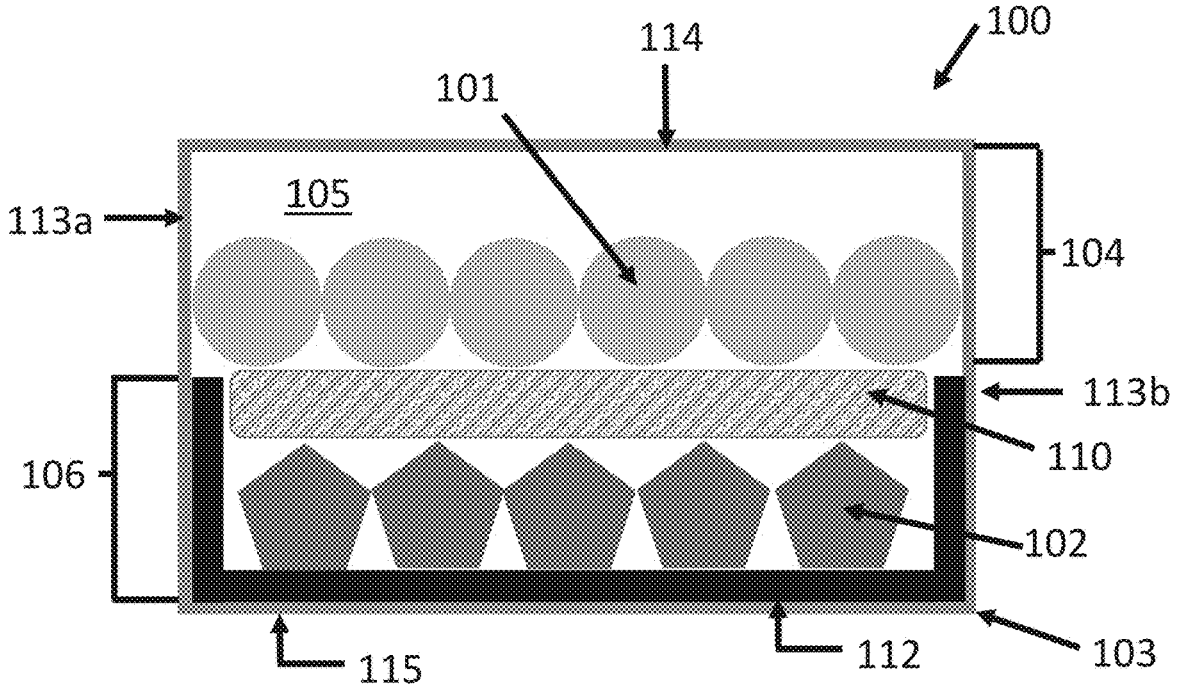
FIG. 1*c* illustrates the stacked arrangement of FIG. 1*a* during a final duration of the transport in which the dry ice has substantially sublimated and the PCM serves as the primary refrigerant to maintain the required cooling temperature regimes of the first perishable item and the second perishable item, respectively, in accordance with the principles of the present invention.

In one aspect of the present invention, FIGS. 1*a*, 1*b* and 1*c* show a two-stage dry ice system 100 at various instances, prior to shipment, and during shipment of a container 103. FIG. 1*a* represents a sectional view of the two-stage dry ice system 100 within the container 103 after preparation of the container 103 but prior to its transport. The two-stage dry ice system 100 is uniquely assembled in a substantially vertically stacked arrangement to preserve a first perishable item 101 and a second perishable item 102. The first perishable item 101 is located in a first region 104 of a holding volume 105 of the container 103. The second perishable item 102 is located in a second region 106 of the holding volume 105 of the container 103. The holding volume 105 does not contain any functional partition or a functional compartment. As used herein and throughout, the term "functional partition" refers to a dividing wall, dividing panel or any other equivalent structure designed to segregate a holding volume into multiple functional compartments and provide insulative properties to enable an independently controlled temperature regime within each of the functional compartments. The term "functional compartment" as used herein means a regional holding volume that is confined or substantially confined by walls within which an item is stored at an independently controlled temperature as a result of heat transfer into or out of the compartment through one or more of the walls The present invention offers a novel system and method for multiple temperature cooling regimes within a single holding volume 105 that is continuous. In other words, the holding volume 105 is not functionally partitioned to create functional compartments. The single holding volume 105 has a two-stage dry ice system 100 in a specific stacked arrangement with respect to a first perishable item 101 and a second perishable item 102. As such, the present invention offers the ability to use a standard container 103 to incorporate the novel two-stage dry ice system 100 to implement the multiple cooling temperature regimes with the single holding volume 105.

Unlike conventional refrigeration systems, the present invention does not employ the use of channels, vents or holes within a functional partition to promote heat transfer across the dividing panel; or routing of coolant through various functional compartments. A possible drawback of such system is uneven distribution of refrigeration, depending on the arrangement of items on each side of the dividing panel. Another drawback is increased cost and complexity of the container itself and potentially increased effort in assembling the package components.

Referring to FIG. 1*a*, a first perishable item 101 is shown stacked onto a phase change material 110 (PCM). The first perishable item 101 can be any type of item, including by way of example, a refrigerated item, required to be maintained within a certain cooling temperature regime for a certain duration while in storage and/or transport. The term "refrigerated item" or "refrigerated food" as used herein means an item or food that is maintained in a temperature range above its freezing point and below a critical temperature, which is typically below ambient conditions. For example, the first perishable item 101 may include produce such as crops, fruits, vegetables, grains, dairy products, or any combination of such items. The first perishable item 101 may be individually placed in direct contact or close proximity to the PCM 110 or consolidated into a bag that is in direct contact or close proximity to the PCM 110. The first perishable item 101 is generally characterized as required to be maintained at a temperature no greater than a certain upper limit temperature to avoid spoilage, but not fall below a lower limit temperature below which the first perishable item is susceptible to damage as a result of excessive cooling. Accordingly, the first perishable item 101 has a so-called "first cooling temperature regime" that is defined as equal to or lower than the upper limit temperature and equal to or greater than the lower limit temperature. It should be understood in practical implementation that the first perishable item 101 may make temporary excursions above the upper limit temperature or below the lower limit temperature as long as the durations of those excursions do not result in degradation and/or spoilage of the first perishable item 101. In one example, the first cooling temperature regime is in a range of 2-8° C. (36-46° F.).

The container may include a supporting structure that is not attached to the inner walls or inner insulative liner of the container 103 and not designed as a barrier to segregate the holding volume 105 into compartments, thereby allowing the holding volume 105 to effectively extend as a single and continuous space. In one example, the supporting structure is a cardboard sheet having a surface that is sufficient for the first perishable item 101 to be loaded thereon into a stable position. The supporting structure can be further characterized as a substantially non-functional, as it is not designed to maintain a first cooling temperature regime within the first region 104 or a second cooling temperature region within the second region 106. The supporting structure provides a platform for the perishable items 101 to be loaded thereon.

Any suitable amount of the first perishable item 101 can be loaded into the first region 104 of the holding volume 105, dependent at least in part upon the size of the holding volume 105 and dimensions of container 103.

Still referring to FIG. 1*a*, a second perishable item 102 is shown stacked into position and in direct contact with dry ice 111. It should be understood that the second perishable item 102 need not be in direct contact with the dry ice 111, but rather can be oriented in close proximity to the dry ice 111 so as to receive the desired refrigeration from the dry ice 111. The second perishable item 102 may be individually placed in direct contact or close proximity to the dry ice 111 or consolidated into a bag that is placed in direct contact or close proximity to the dry ice 111. The second perishable item 102 can be any type of item required to be maintained within a certain cooling temperature regime for a certain duration while in storage and/or transport. For example, the second perishable item 102 may include frozen items such as meat, fish, poultry or any combination of such items. The term "frozen food" or "frozen items" as used herein and throughout refers to a food or item that is at least partly frozen when loaded into the container prior to shipping; the "frozen food" or "frozen item" may be completely or substantially thawed but still preserved below a critical temperature threshold at time of delivery. The second perishable item 102 is generally characterized as required to be maintained at a temperature no greater than an upper limit temperature to avoid spoilage. Accordingly, the second perishable item 102 has a so-called "second cooling temperature regime" that is defined as equal to or lower than the upper limit temperature. In one example, the second cooling temperature regime is below −15° C. (5° F.). Preferably, the second perishable item is to be maintained at a second cooling temperature regime with an upper bound temperature that is lower than the upper bound temperature of the first cooling temperature regime of the first perishable item 101.

Still referring to FIG. 1*a*, a phase change material (PCM) 110 is located in the first region 104. The PCM 110 is in close proximity to the first perishable item 101 whereby the PCM 110 occupies the same first region 104 as the first perishable item 101. The PCM 110 is part of the two-stage dry ice system 100. The PCM 110 is at least partially liquid at the time the package is assembled (time "t0" in FIG. 1*a*). Any suitable PCM 110 can be utilized, including, by way of example and not intending to be limiting, PCM's with polymers mixed-in, gel-like PCM's and sponge-like rigid PCM's. In a preferred embodiment, the PCM 110 is water. The water can be at a temperature ranging between 32-75° F. (i.e., a thawed state), and more preferably between 32-50° F. in a completely or substantially thawed state. The water is confined in a flexible or rigid plastic bag or pouch (i.e., a "PCM pack"). It should be understood one or more PCM packs can be used with the various embodiments of the present invention. In the example shown in FIGS. 1*a*, 1*b* and 1*c*, the size and amount of the PCM packs will depend on several factors, including, by way of example, the weight of the first perishable items 101 and the second perishable items 102, the expected delivery time, the insulation properties of the container 103, the ambient temperature during transport and the amount of dry ice 111 in second region 106.

The PCM 110, in accordance with the principles of the present invention, is designed to be used as the primary refrigerant during transport of the container 103 during a "final duration" of the transport. As used herein, and for purposes of clearly illustrating principles of the present invention, the transport of the container 103 with perishable items (101, 102) and the two-stage dry ice system 100 can be divided into two stages, namely an "initial duration" and a "final duration". The "initial duration" represents the elapsed time from preparation of the container 103 at time t0 in FIG. 1*a* to a specific configuration of the two-stage dry ice system 100 at time t2 in FIG. 1*c*, during which dry ice 111 acts as the primary refrigerant. The "final duration" of the transport is intended to mean the elapsed time from time t2 in FIG. 1*c* to arrival of the container 103 to its final destination (not shown), during which the PCM 110 acts as the primary refrigerant.

Dry ice 111 as shown in FIG. 1*a* occupies the second region 106 of holding volume 105. The dry ice 111 has a suitable density and may be in any form, such as nuggets, flakes, or slab. The dry ice 111 has a predetermined weight that is defined as a weight greater than a lower limit so as to achieve the extended duration (i.e., the preservation of the first perishable item 101 and the second perishable item 102) but not greater than an upper limit that imparts excessive cooling to the first perishable item 101 so as to attain a temperature below the lower limit of the first cooling temperature regime. The dry ice 111 is shown in direct contact with the second perishable item 102. Alternatively, the dry ice 111 may be in close proximity to the second perishable item 102. As will be described in detail herein below, the dry ice 111 in accordance with the principles of the present invention is designed to be used as the primary refrigerant during transport of the container 103 during the "initial duration" of the transport.

An insulative material 112 (e.g., foam pads, fibrous materials and porous materials) partially encapsulates the second perishable item 102 as shown in FIGS. 1*a*, 1*b* and 1*c*. A surface of the second perishable item 102 preferably remains unbounded by the insulative material 112 to enable direct contact with the dry ice 111. The insulative material 112 reduces the amount of heat leakage into the second region 106 so as to prevent dry ice 111 from sublimating too fast and prevent the second perishable item from warming beyond acceptable levels. The partial encapsulation by the insulative material 112 is a necessary feature for the refrigeration to function for an extended duration. Applicants have discovered that insulative material 112 that entirely encapsulates the second perishable item 102 yields poor performance (i.e., the first perishable item 101 tends to attain a temperature above the upper limit of its first cooling temperature regime, as will be described in the tests, herein below). On the other hand, Applicants have also discovered that the absence of any insulative material 112 along the second perishable item 102 tends to cause the dry ice 111 to sublimate too quickly. It should be understood that the partial encapsulation of insulative material 112 may be incorporated or built into the inner lining of the container 103 itself or be separate and distinct from the inner lining of the container 103 as shown in the Figures. Alternatively, although not shown in the Figures, it should be understood that the insulative material 112 may include a material in contact with the dry ice 111 that provides negligible insulative effects (e.g., plastic). The material is preferably flexible and may be integral to the insulative material 112 or a separate and distinct covering to the insulative material 112, either of which does not impede the PCM 110 to shift into close proximity to the second perishable items 102 as shown in FIGS. 1*b* and 1*c*.

The container 103 includes side walls 113*a*, 113*b*, and additional non-hermetic (not shown), a first surface 114 and a second surface 115. Any type of size and shape container 103 can be used with the present invention. The size of the container may depend, at least in part, upon the amount of first perishable items 101 and second perishable items 102 to be stored and/or transported.

Various amounts of dry ice 111 and PCM 110 can be utilized with the present invention. In one embodiment of the of the present invention, the system comprises a ratio of weight of the PCM to weight of the dry ice greater than about 0.1 and less than 5, and preferably greater than about 0.5 and less than 1.1.

In operation, as the container 103 is transported to an intermediate location or final destination, the dry ice 111 imparts the requisite cooling as it serves as the primary refrigerant during the initial duration of transport. During this initial duration, the refrigeration is directly imparted from the dry ice 111 to the second perishable item 102 to maintain the second perishable item 102 at its required second cooling temperature regime. Additionally, refrigeration is imparted from the dry ice 111 to the first perishable item 101 via PCM 110. The cooling effects of the PCM 110 are secondary in comparison to that of the dry ice 111 during the initial duration, and the PCM 110 imparts no cooling to the first perishable item 101 when the PCM 110 has a temperature that is higher than that of the first perishable item 101. Nonetheless, Applicants have discovered that the PCM 110 is a necessary element during the initial duration, because the PCM 110 acts to store and suppress the amount of cooling imparted by the dry ice 111 to the first perishable item 101 thereby preventing the first cooling temperature regime from falling below its minimum temperature. Additionally, the PCM 110 during the initial duration is configured to undergo a phase change from a thawed state to at least a partially frozen state as the dry ice 111, which is at a lower temperature than the PCM, may continue to impart cooling to the PCM 110. In this manner, this so-called partially or fully frozen state of the PCM 110 stores refrigeration which can be subsequently utilized to extend cooling duration when the dry ice 111 has substantially sublimated (as will be explained below). FIG. 1*b* is a representative sectional view of the configuration of the two-stage dry ice system 100 of the container 103 in transport at time t1, where t1 represents a time after t0, and further where t1 is a time during the initial duration of the transport. FIG. 1*b* is intended to represent the configuration of the container 103 at t1 during shipment to a final destination. At time t1, dry ice 111 has partially sublimated from solid to vapor as evidenced by a reduction in the amount of solid dry ice 111 occupying the second region 106 of the holding volume 105. The dry ice 111 acts as the primary refrigerant during time t1. The first and second perishable items (101, 102) remain cooled within their first cooling temperature regime and second cooling temperature regime, respectively, in the presence of dry ice 111. During time t1, the presence of dry ice 111 can be characterized by a temperature difference between the first perishable item 101 within the first region 104 and the second perishable item 102 within the second region 105. In one example, the temperature difference is 4° F. or higher. When dry ice 111 is present and is in direct contact with the second perishable item 102, the temperature of the second perishable item 102 is closer to the dry ice temperature (−109° F.) compared to the phase change temperature of the PCM 110. On the other hand, the temperature of the first perishable item 101 can be maintained at a temperature that is at or slightly above the phase change temperature of the PCM 110.

As the dry ice 111 sublimates into vapor, the CO2 vapor vents through the non-hermetic side walls 113*a*, 113*b* and additional non-hermetic side walls (not shown) of container 103 and first surface 114 and second surface 115 of container 103. Any shape container 103 can be utilized. The second perishable item 102 remains partially encapsulated within insulative material 112. The PCM 110 at time t1 may continue to undergo a phase change from a thawed state to at least a partially frozen state as the dry ice 111, which is at a lower temperature than the PCM, may continue to impart cooling to the PCM 110.

As the dry ice 111 continues to sublimate into CO2 vapor and eventually constitute a smaller proportion of the dry ice system 100 during transport, the requisite cooling enters a second stage, in which the partially or fully frozen PCM 110 is the primary refrigerant. Entry into the second stage is intended to denote a final duration of the transport. At the second stage, the cooling is primarily imparted by the PCM 110 during a final duration of the transport. The shift in cooling is represented by FIG. 1*c*. FIG. 1*c* is a representative sectional view of the configuration of the two-stage dry ice system 100 of the container 103 in transport at time t2, where t2 represents a time after t1, and further where t2 is a time during the final duration of the transport. During the final duration, substantially all of the dry ice 111 has sublimated. The complete sublimation of the dry ice 111, as shown in FIG. 1*c*, creates a gap in the region previously occupied by the dry ice 111, such that the first perishable items 101 and PCM 110 can drop onto the second perishable items, as a result of gravity, to directly contact a surface of the second perishable item 102, while the PCM 110 remains in close proximity to the first perishable item 101. The second perishable item 102 remains partially encapsulated within insulative material 112. The PCM 110 and the insulative layer 112 are in contact with different surfaces of the second perishable item 102 to create an enclosed section around the second perishable item 102 that allows the second perishable item 102 to remain within its second cooling temperature regime during the final duration. While not shown in FIG. 1*c*, it should be understood that a residual amount of dry ice 111 may remain in the holding volume 105 during the final duration of the transport as the PCM 110 is acting as the primary refrigerant.

The controlled and delayed onset of refrigeration provided by the PCM 110 and the ability of the stacked arrangement of the dry ice system 100 to reorient during transport can allow preservation of the first and second perishable times (101, 102) for an extended duration. Without being bound by any particular theory, it is believed that the ability of the PCM 110 to drop onto and thereby contact or be in close proximity to a surface of the second perishable item 102 upon sublimation of the dry ice 111 enables the PCM 110 to act as the primary refrigerant and impart the requisite cooling to the first perishable item 101 and the second perishable item 102. However, it should be understood that the beneficial effects of preservation of the first and the second perishable items (101, 102) for an extended duration may still be obtained even if the PCM 110 does not entirely drop onto the second perishable item 102 to be in direct contact with therewith, as shown in FIG. 1*c*. Unlike conventional refrigeration techniques, the present invention intentionally employs a transient two-stage refrigeration system that is adapted to reconfigure the contents within its first region 104 and second region 106 to optimize the utilization of refrigeration while maintaining the first and second cooling temperature regimes.

Figure 2A:
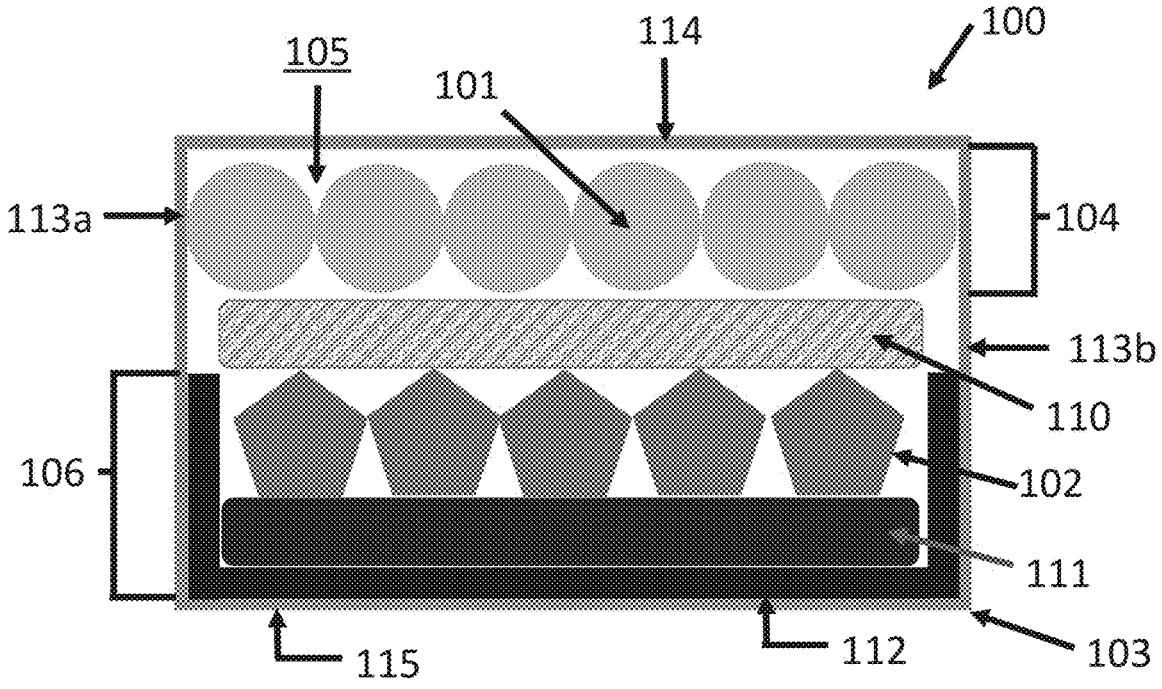
FIG. 2*a* illustrates an alternative stacked arrangement of PCM and dry ice with the first perishable item and the second perishable item as part of an alternative two-stage dry ice system after preparation of the container and prior to transport in accordance with the principles of the present invention.
Figure 2B:
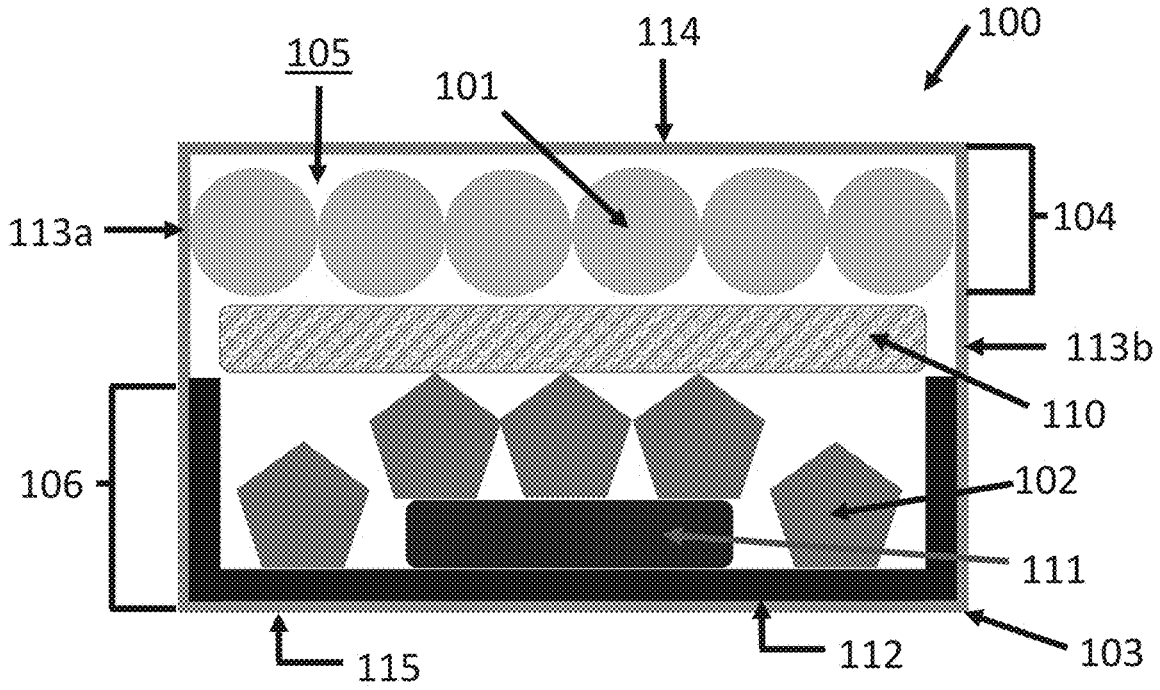
FIG. 2*b* illustrates the stacked arrangement of FIG. 2*a* during an initial duration of the transport in which the dry ice serves as the primary refrigerant to maintain the required cooling temperature regimes of the first perishable item and the second perishable item, respectively, in accordance with the principles of the present invention.
Figure 2C:
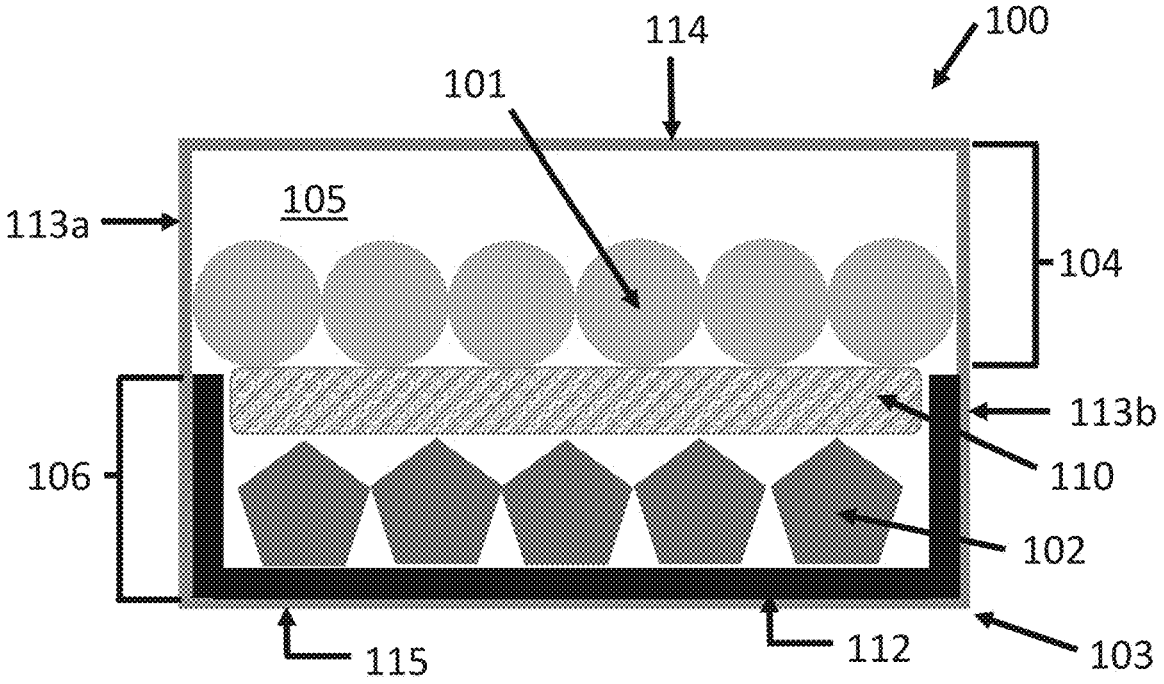
FIG. 2*c* illustrates the stacked arrangement of FIG. 2*a* during a final duration of the transport in which the dry ice has substantially sublimated and the PCM serves as the primary refrigerant to maintain the required cooling temperature regimes of the first perishable item and the second perishable item, respectively, in accordance with the principles of the present invention.

Other stacked arrangements are possible with the present invention. As an example, FIGS. 2*a*, 2*b* and 2*c* show an alternative arrangement of the present invention. Referring to FIG. 2*a*, the dry ice 111 is arranged in close proximity or direct contact to the insulative material 112 within the second region 106 of holding volume 105. Similar to FIG. 1*a*, the dry ice 111 remains in close proximity or direct contact to the second perishable item 102 and the PCM 110 within the second region 106. The PCM 110 remains in close proximity or direct contact to the first perishable item 101. The insulative material 112 remains oriented (i.e., partially encapsulated around the second perishable item 102) in a similar manner as that of FIG. 1*a*. The mechanism by which the two-stage refrigeration occurs is believed to be essentially identical to that described with respect to FIGS. 1*a*, 1*b*, and 1*c*.

Figure 6:
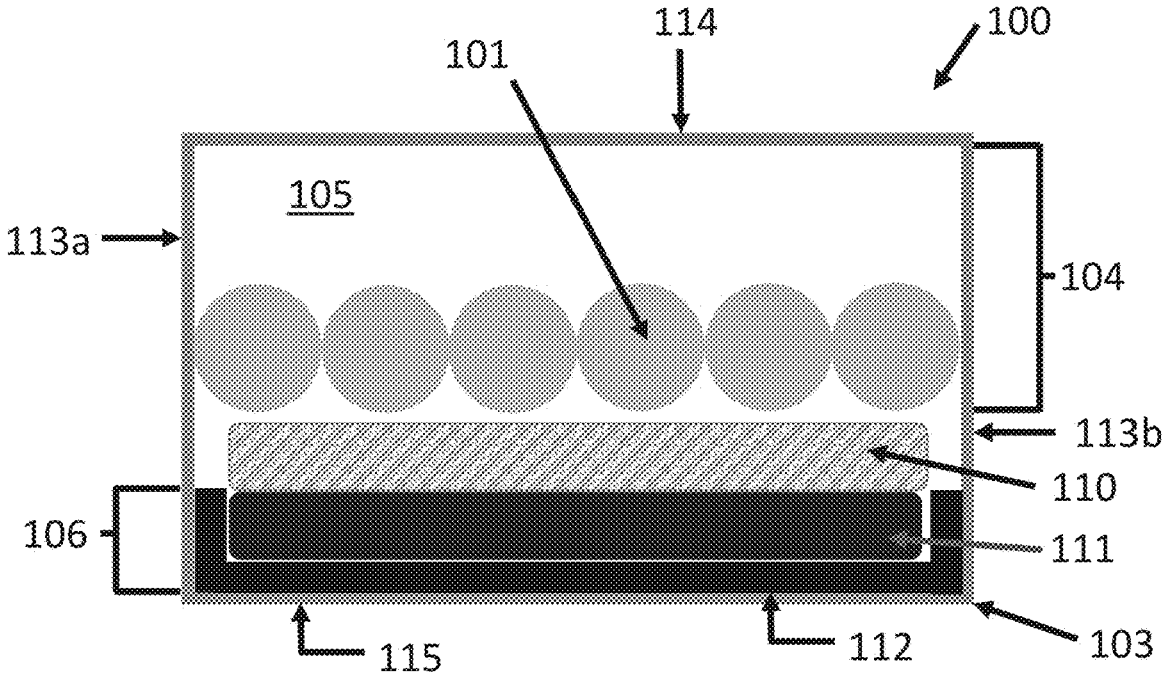
FIG. 6 shows an alternative embodiment in which the two-stage dry ice system of the present invention is utilized to maintain a cooling temperature regime for one type of perishable items.

In an alternative embodiment, the improved two-stage dry ice system 100 may be arranged to preserve a single type of perishable item (i.e., identical items or a combination of different items at the start of shipment, such as frozen and refrigerated, that require the identical cooling temperature regime during shipment) as opposed to a first and second perishable item described in FIGS. 1*a*-1*c* and 2*a*-2*c*. One example is shown in FIG. 6. In such an arrangement, a container 103 has a holding volume with the perishable item 101 loaded therein. The perishable item 101 is maintained at its required cooling temperature regime. Although perishable items 101 are shown, it should be understood that first perishable items 101 can be replaced with second perishable items 102 within the holding volume 105. A PCM 110 is located between a surface of the perishable item and a surface of a predetermined amount of dry ice 111. The dry ice 111 is at a lower temperature than the PCM 110. The PCM 110 and the dry ice form a substantially stacked arrangement with the perishable item to create a dry ice system. Similar to the arrangements in FIGS. 1*a*-1*c* and 2*a*-2*c*, the dry ice 111 serves as a first primary refrigerant to maintain the cooling temperature regime of the perishable item during an initial duration of transport, subsequently followed by the PCM 110 serving as a second primary refrigerant for continuing to maintain the cooling temperature regime of the perishable item during a final duration of the transport.

Other variations to the inventive stacked arrangements are contemplated by the present invention. For example, the PCM 110 can be situated in close proximity to the first perishable item 101 and the dry ice 111 can be situated in close proximity to the second perishable item 102; or the PCM 110 can be in direct contact with the first perishable item 101 and the dry ice 111 can be in close proximity to the second perishable item 102; or the PCM 110 can be in close proximity with the first perishable item 101 and the dry ice 111 can be in direct contact with the second perishable item 102. In another variation, the stacked arrangement may include only refrigerated items occupying the first region 104 and second region 106; or the stacked arrangement may include only frozen items occupying the first region 104 and the second region 106. Alternatively, it should be understood that the types of first perishable item 101 and second perishable item 102 may be different but have substantially similar cooling temperature regimes. Still further, in another embodiment, the stacked arrangement utilizes dry ice 111 as the primary refrigerant throughout delivery. In another embodiment, the insulative materials 112 is removed and can be incorporated into the inner lining of the container 103.

Figure 3:
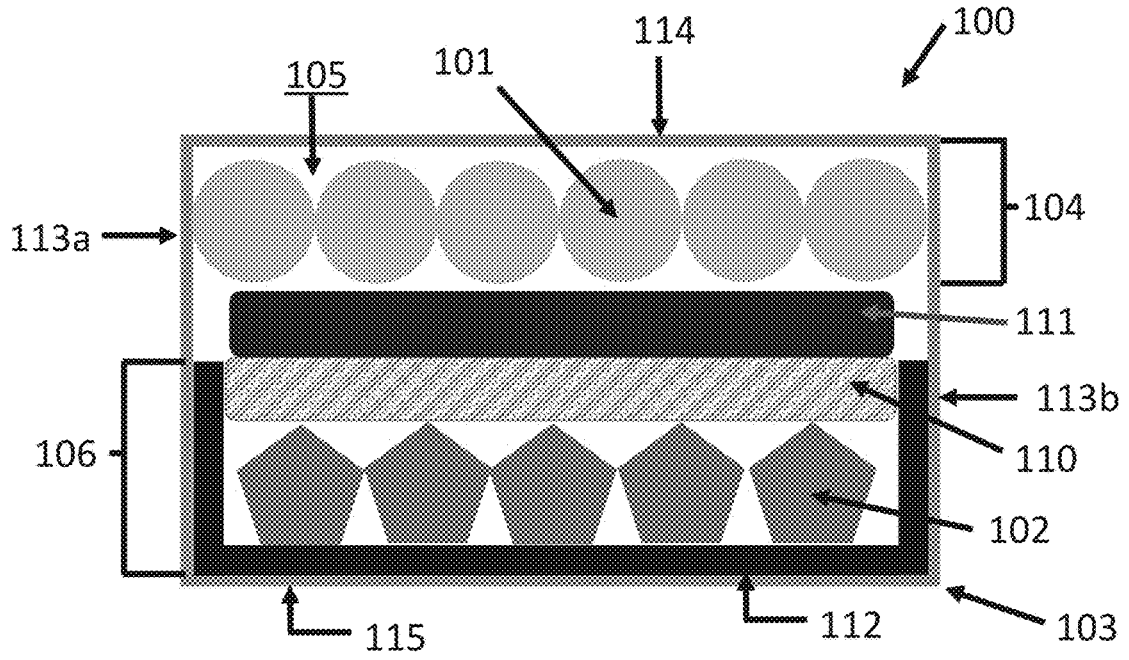
FIG. 3 shows a stacked arrangement where the dry ice is not in close proximity to the second perishable items, and the PCM is not in close proximity to the first perishable items.
Figure 4:
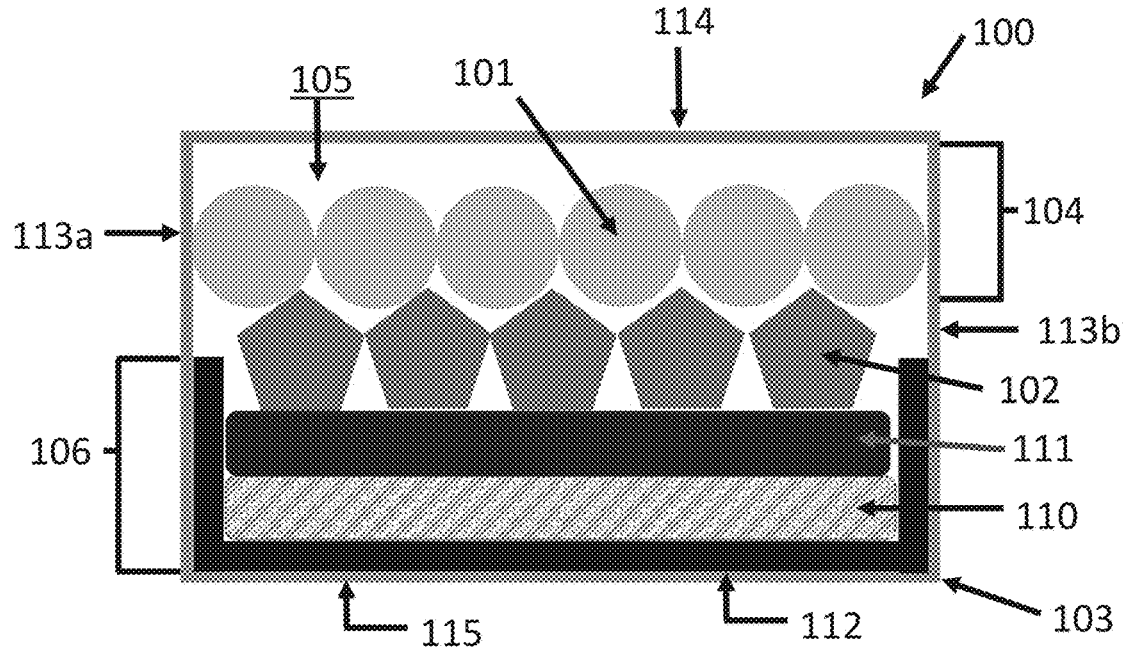
FIG. 4 shows a stacked arrangement where the PCM is not in close proximity to the first perishable items and the second perishable items are not partially encapsulated by insulative material.

While certain modifications to the stacked arrangement are contemplated to be within the scope of the present invention, Applicants have discovered that the present invention does impose restrictions to the types of stacked arrangements that can deliver adequate cooling performance. For example, Applicants have discovered that the PCM 110 must be in direct contact or in close proximity to the first perishable item (e.g., refrigerated items) having a first cooling temperature regime and the dry ice must be in direct contact or in close proximity to the second perishable item (e.g., frozen items) having a second cooling temperature regime with an upper limit temperature that is lower than the upper limit temperature of the first cooling temperature regime. In other words, a stacked arrangement where the PCM 110 is between the dry ice 111 and frozen items 102 and the dry ice 111 is between the refrigerated items 101 and the PCM 110 (as shown in FIG. 3) has a tendency to fail to meet applicable cooling performance criteria. Specifically, this orientation can cause the refrigerated items 101 to be damaged as a result of excessive cooling and the frozen items 102 to not receive enough refrigeration as a result of the PCM 110 undesirably acting as a refrigeration sink. In another example, FIG. 4 shows a stacked arrangement where the PCM 110 is not in close proximity to the refrigerated items 101 and the frozen items 102 are not partially encapsulated by insulative material 112. The failure to maintain the PCM 110 in close proximity to the first perishable item 101 (e.g., refrigerated items) having a first cooling temperature regime with upper limit temperature greater than the upper limit temperature of the second cooling temperature regime of the second perishable item 102 (e.g., frozen items) in combination with placement of the frozen items 102 adjacent to the refrigerated items 101 has a tendency to cause the refrigerated items 101 to become excessively cold and possibly degrade. Additionally, not partially encapsulating the frozen items 102 and dry ice 111 has been discovered to introduce excessive heat leakage from the ambient atmosphere into the frozen items 102. These empirical observations have led Applicants to conclude that the present invention requires (i) a direct contact or close proximity arrangement of the dry ice 111 with second perishable item 102 in a second region 106 of holding volume 105; (ii) a direct contact or close proximity arrangement of the PCM 110 with first perishable item 101 in a first region 104 of holding volume 105; (iii) the second perishable items and dry ice 111 partially encapsulated with an insulative material 112; (iv) the dry ice 111 and PCM 110 throughout the shipment in direct contact with each other as shown in FIGS. 1*a* and 1*b* or in the configuration as shown in FIGS. 2*a* and 2*b*; (v) no direct contact and no close proximity between dry ice 111 and the first perishable item 101, particularly when the first perishable item 101 is a refrigerated item; and (vi) direct contact or close proximity between the PCM 110 and second perishable item 102 when the dry ice 111 has sublimated.

As will be shown and discussed below, Applicants performed various tests to simulate transport conditions as a means to assess whether certain stacked arrangements were capable of preserving refrigerated and frozen items. It was determined that the stacked arrangement of the present invention allowed the first perishable item and the second perishable item to remain preserved for an extended duration in comparison to other stacked arrangements.

For each of the tests shown below, three pieces of frozen items consisting of animal protein were used after being preconditioned at 9-11° F. for 24 hours or longer, prior to beginning testing. The approximate weight of each frozen item was 0.8-1 lb.

Each of the three tests also included refrigerated items. The refrigerated items consisted of vegetables, grains, dairy and dry spices. The refrigerated items were placed inside a thin paper bag, which offered negligible insulation. For each test, three bags of refrigerated items were used, with each bag weighing approximately 1.2-1.5 lb. The refrigerated items were preconditioned at 40° F. for at least 24 hours prior to beginning testing. The temperature of the refrigerated items was measured at three locations to account for temperature variability within each container. The temperature of the frozen items was measured at locations furthest away from the dry ice. On the other hand, the refrigerated items' temperature was measured at locations closest to the refrigerant (dry ice or PCM pack). The temperature was logged every 5 minutes for the duration of each test.

For each of the tests, a slab form of dry ice was used. The dry ice's thickness was approximately 2 inches for all tests, while the amount of dry ice varied by changing the other two dimensions (length and width). The chilling duration was tested against two different ambient temperatures: 90° F. and 100° F. The PCM utilized for all tests was a gel pack, primarily composed of water with approximately 5 lbs. weight. The gel pack's dimension was approximately 9 inches×12 inches×1.5 inches.

In all packaging tests described below, the same delivery container was utilized. The delivery container was made of non-hermetic material formed from cardboard to prevent the pressure build up due to dry ice sublimation. For each of the tests described below, a corrugated cardboard box was used having dimensions of 11 inches×14 inches×14 inches. The corrugated cardboard box was lined inside with 1-inch-thick loose fill natural fiber material that has thermal resistance $R=1.5\ F^{\circ}\cdot ft^2\cdot hr\cdot BTU^{-1}$ per inch of thickness. The loose fill natural fiber liner was encased within low density polyethylene film. The loose fill natural fiber liner did not contribute to pressure build up within the box. The delivery container was maintained stationary and in a vertically oriented position.

Example 1a (Invention: Refrigerated Items/Thawed Gel Pack/Frozen Items/Dry Ice at 90° F. Ambient)

A delivery container was prepared with refrigerated items and frozen items. The stacked arrangement from top to bottom of the delivery container was as follows: refrigerated items/thawed gel pack/frozen items/dry ice. The stacked arrangement is represented by FIG. 2*a*. The frozen items were required to remain below 40° F. The refrigerated items were required to be maintained between 32° F. to 50° F.

Two tests were conducted at an ambient temperature of 90° F. For each test, 7.5 lbs. of dry ice and 5 lbs. of thawed gel pack were used. Two types of additional insulation materials were used for the frozen items and dry ice: synthetic rubber foam ($R=1.5\ F^{\circ}\cdot ft^2\cdot hr\cdot BTU^{-1}$) and expanded polymer foam board ($R=1.5\ F^{\circ}\cdot ft^2\cdot hr\cdot BTU^{-1}$). The additional insulation (9"×12"×4", OD) covered the bottom face of the container, and partially covered four vertical faces of the container with the top surface of the frozen items uninsulated.

The test results indicated that two temperature zones were successfully maintained with this stacked arrangement. The frozen items, which needed to remain below 40° F., were cooled by dry ice during the initial 25-45% of the target delivery time as determined by monitoring the item temperatures inside the box. The refrigeration also passed to the thawed gel pack during this time, causing freezing of a portion of the thawed gel pack. It was observed that the temperature of the gel pack did not fall below its freezing point, indicating its solidification was only partly complete. When the dry ice completely sublimated, the partially frozen gel pack started to act as a secondary coolant for the rest of the delivery time. In both experiments at an ambient temperature of 90° F., the dry ice remained for 30-40 hours. The frozen items remained below 40° F. for over 72 hours in both tests. Refrigerated items were maintained at a temperature between 32° F. and 50° F. for 50 hours or longer in both tests.

In addition to the change of primary coolant (from dry ice to partially frozen PCM pack), it was observed that the physical stacked arrangement within the delivery container also changed over time. After the dry ice sublimated from solid to gas, the space occupied by the dry ice became available for other components of the dry ice system. Applicants observed a natural downward shift of items by gravity with the resultant configuration as represented in FIG. 2*c*. By strategically placing more insulation at the bottom of the delivery container, it was determined a longer chilling duration below 40° F. was accomplished for the protein.

Example 1b (Invention: Refrigerated Items/Thawed Gel Pack/Frozen Items/Dry Ice at 100° F. Ambient)

The same stacked arrangement as in Example 1a was utilized at a higher ambient temperature of 100° F. 5.3 lbs. of dry ice and 5 lbs. thawed gel pack were utilized. Loose fill natural fiber (R=1.5 $F^{\circ}\cdot ft^2\cdot hr\cdot BTU^{-1}$) was used as additional insulation for the frozen items and dry ice. The additional insulation (outside dimensions 9 inches×12 inches×4 inches) covered the bottom face of the delivery container, and partially covered four vertical faces of the container with the top surface of the frozen items remaining uninsulated. In the average of 3 repeats of the test, dry ice lasted for 20-30 hours, the frozen items' temperature remained below 40° F. for 60 hours, and the refrigerated items' temperature remained between 32° F. and 50° F. for 58 hours.

In addition to the change of primary coolant (from dry ice to partially frozen PCM pack), it was observed that the physical stacked arrangement within the delivery container also changed over time. After the dry ice sublimated from solid to gas, the space occupied by the dry ice became available for other components of the dry ice system. Applicants observed a downward shift of items by gravity with the resultant configuration as represented in FIG. 2*c*. By strategically placing more insulation at the bottom of the delivery container, it was determined a longer chilling duration below 40° F. was accomplished for the protein.

Example 2 (Invention: Refrigerated Items/Thawed Gel Pack/Dry Ice/Frozen Items at 90° F. Ambient)

A delivery container was prepared with refrigerated items and frozen items. The stacked arrangement from top to bottom was as follows: refrigerated items/thawed gel pack/dry ice/frozen items. The stacked arrangement is represented by FIG. 1*a*.

A test was conducted at an ambient temperature of 90° F. 6.2 lbs. of dry ice and 5 lbs. thawed PCM pack were utilized. Synthetic rubber foam (R=1.5 $F^{\circ}\cdot ft^2\cdot hr\cdot BTU^{-1}$) was used as additional insulation for the frozen items and dry ice. The additional insulation (outer dimensions 9 inches×12 inches×4 inches) covered the bottom face of the delivery container, and partially covered four vertical faces of the container with the top surface of the frozen items remaining uninsulated. The dry ice lasted for 25-35 hours. The frozen items were kept under 40° F. for 62 hours. The refrigerated items were kept between 32° F. and 50° F. for 45 hours or longer.

In this test, temperature profiles similar to Examples 1a and 1b were observed for both the frozen items (below 40° F.) and the refrigerated items (32-50° F.), despite the change in the location of the dry ice in comparison to the stacked arrangement of Examples 1a and 1b. Applicants concluded that a change in the stacking arrangement occurred because of dry ice sublimation. After the dry ice sublimated from solid to gas, the space occupied by the dry ice became available for other components of the dry ice system. Applicants observed a downward shift of items by gravity, with the resultant configuration as represented in FIG. 1*c*. After natural rearrangement, the final stacked arrangement was determined to be essentially identical to the stacked arrangement in Examples 1a and 1b.

Comparative Example 1a (Refrigerated Items/Frozen Gel Pack/Frozen Items/Frozen Gel Pack at 90° F.)

An alternative stacked arrangement was tested to determine the effectiveness of using two frozen gel packs in combination with refrigerated and frozen items. The arrangement from top to bottom was as follows: refrigerated items/frozen gel pack/frozen items/frozen gel pack. Frozen items were placed between two frozen gel packs to provide chilling from two directions. Refrigerated items were placed on top to prevent damage by the weight of the other items in the delivery container.

One test at 90° F. contained 10 lbs. of frozen gel pack (5 lbs.×2, preconditioned at 9-11° F.) as the refrigerant. No additional insulation was used. The frozen items were kept under 40° F. for 48 hours. The frozen items were kept between 40° F. for 48 hours. The refrigerated items were kept between 32° F. and 50° F. for 60 hours.

The temperature profiles of the frozen and refrigerated items were different from Examples 1a, 1b and 2. It was determined that because the frozen gel pack changed its phase from solid to liquid at approximately 32° F., the temperature of both frozen and refrigerated items remained close to 32° F. There was no significant shift of the frozen items' temperature, which was observed with the stacked arrangements of Examples 1a, 1b and 2 when the cooling shifted from dry ice to the frozen gel pack.

Another major difference was that the duration of maintaining the required cooling temperature regimes for the refrigerated and frozen items were shorter than that achieved by the tests of Examples 1a, 1b and 2, especially for the frozen items. Also, in comparison to Examples 1a, 1b and 2, the temperature profile showed higher variance from one test to another, depending on the shape of the frozen gel pack. For these reasons, Applicants concluded that the cooling characteristics were inferior to those observed in Examples 1a, 1b and 2.

Comparative Example 1b (Refrigerated Items/Frozen Gel Pack/Frozen Items/Frozen Gel Pack at 100° F.)

The same stacked arrangement as in Comparative Example 1a was utilized to run a single test, but in this instance, the test was performed at a higher ambient temperature of 100° F. 10 lbs. of frozen gel pack (5 lbs.×2, preconditioned at 9-11° F.) was used as refrigerant. Foil-faced bubble wrap (R=0.4 $F^{\circ}\cdot ft^2\cdot hr\cdot BTU^{-1}$) was used as extra insulation, covering all six faces of the cardboard box. The frozen items were kept under 40° F. for 38 hours. The refrigerated items were kept between 32° F. and 50° F. for 40 hours. The cooling characteristics exhibited a shorter duration than those observed in Examples 1a, 1b and 2.

Comparative Example 1c (Refrigerated Items/Thawed Gel Pack/Frozen Items/Dry Ice with Increased Insulation at 90° F. Ambient)

The same stacked arrangement as in Example 1a was utilized at an ambient temperature of 90° F. 6.2 lbs. of dry ice and 5 lbs. of thawed gel pack were utilized. Synthetic rubber foam insulation ($R=1.5\ F°\cdot ft^2\cdot hr\cdot BTU^{-1}$) was used as additional insulation for the frozen items and dry ice. The difference between this test and Example 1a was in the dimensions of the additional insulation. In this test, the additional insulation was taller than the insulation used in Example 1a. The additional insulation (outside dimensions 9 inches×12 inches×4.5 inches) covered the bottom face of the delivery container, and partially covered four vertical faces of the container with the top surface of the frozen items remaining uninsulated.

In this test, dry ice lasted 20-30 hours, and the frozen items' temperature remained below 40° F. for 59 hours. The refrigerated items' temperature fell below 32° F. for the initial 25 hours, remained between 32° F. and 50° F. for the next 15 hours, and went above 50° F. for the rest of the test duration.

This example demonstrated the importance of the insulation element's dimension. Because of the larger dimensions of the insulation element in this test, the gel pack not only failed to sufficiently protect the refrigerated items, but also was unable to maintain the close proximity with the refrigerated item after the items rearranged. While the dry ice was the major coolant (t1), the cold vapor from dry ice seemed to have bypassed the gel pack and lowered the refrigerated items' temperature below 32° F. After a significant portion of the dry ice sublimed (t2), the items in the second region of the holding volume rearranged causing the gel pack to reposition into the second region of the holding volume. However, the insulation element's additional height prevented the refrigerated items from repositioning onto the gel pack. Hence, the close proximity between the gel pack and the refrigerated items was not maintained after the rearrangement, resulting in the refrigerated items' temperature to rise rapidly. By increasing the dimensions of the additional insulation from that of Example 1a to that utilized in this test, the desired chilling characteristics were not achieved.

Suitably sized insulation, as utilized in Example 1a, was determined to allow the PCM (i.e., gel pack) to intentionally shift downwards when dry ice sublimates such that there is direct contact or close proximity between the PCM and second perishable item when the dry ice is consumed. In this manner, the smaller sized insulation can contribute to desired cooling characteristics.

Comparative Example 2 (Refrigerated Items/Frozen Gel Pack/Frozen Items/Dry Ice)

An alternative stacked arrangement was tested. The arrangement from top to bottom was as follows: refrigerated items/frozen gel pack/frozen items/dry ice. The arrangement was similar to that of FIG. 1*a* of Example 2, except a frozen gel pack of the same mass was used instead of a thawed gel pack. One test was performed at 100° F. and contained 4.8 lbs. of dry ice and 5 lbs. frozen gel pack. Loose fill natural fiber ($R=1.5\ F°\cdot ft^2\cdot hr\cdot BTU^{-1}$) was used as extra insulation for the frozen items and dry ice. The additional insulation (outer dimensions 9 inches×12 inches×4 inches) covered the bottom face of the delivery container, and partially covered four vertical faces of the box with the top of the frozen items uninsulated.

Dry ice remained for 25-35 hours. The temperature of the frozen items remained below 40° F. for 55 hours. The produce items did not stay between 32° F. and 50° F. until 32 hours after the test started. Prior to 32 hours into the test, the refrigerated items were kept below 32° F., which was not desired due to the risk of quality degradation as a result of excessive freezing.

Because the gel pack was initially below 32° F., the temperature of refrigerated items was not maintained at about 32° F. Instead, the temperature was observed to gradually decrease below 32° F., causing freezing of the refrigerated items over an extended period. The temperature was restored to above freezing, after the dry ice had completely sublimated. The test results were considered unacceptable as the cooling temperature of the refrigerated items was too cold. The test demonstrates that the combination of dry ice with a PCM does not necessarily create acceptable refrigeration when configured in a stacked arrangement that deviates from that of the present invention.

Comparative Example 3 (Refrigerated Items/Fully Encapsulated Insulation Layer without PCM/Frozen Items/Dry Ice at 90° F.)

Figure 5:
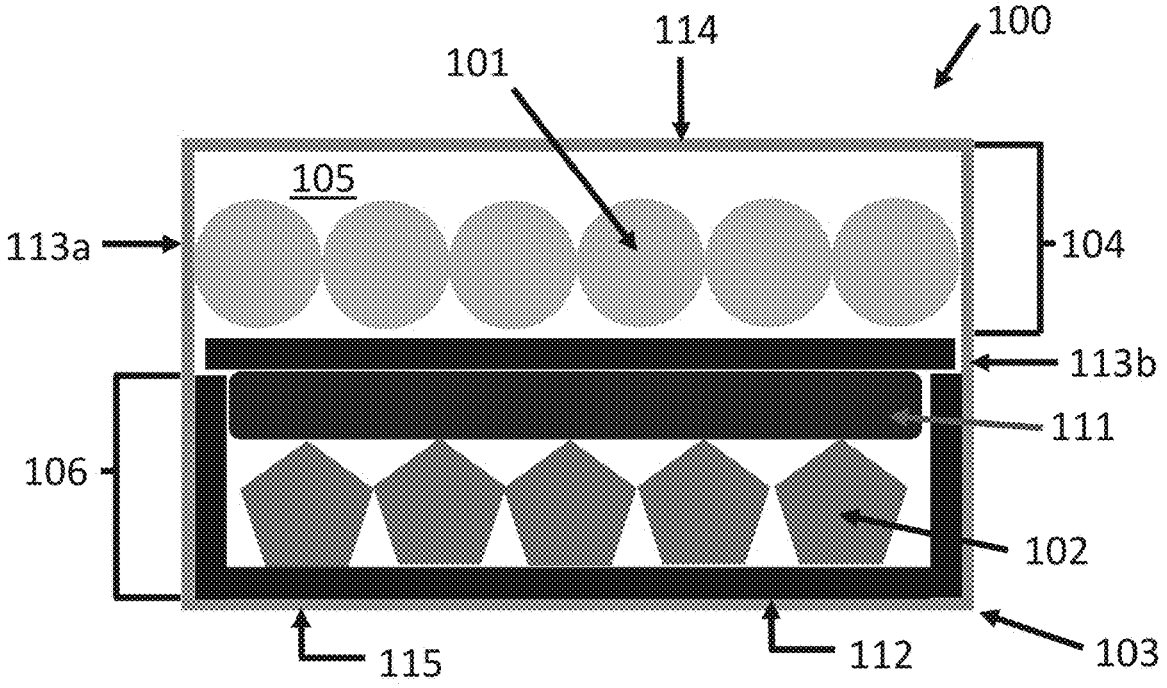
FIG. 5 shows a stacked arrangement without a PCM in which additional insulation completely extends around the second perishable items and dry ice to form rigid insulation (i.e., the arrangement of Comparative Example 3)

An alternative stacked arrangement was tested as shown in FIG. 5. The arrangement from top to bottom was as follows: refrigerated items/fully encapsulated insulation layer/frozen items/dry ice. This arrangement represented a so-called "rigid insulation stacked arrangement" without PCM in which additional insulation completely extended around the second perishable items and dry ice. This arrangement was similar to the arrangements of Examples 1a and 1b, except the thawed gel pack was replaced by a sheet of insulation material. Applicants tested this arrangement in order to validate whether the layer of insulation between the frozen and refrigerated items would protect the refrigerated items from freezing.

One test at 90° F. was carried out with 6.2 lbs. of dry ice and 5 lbs. of thawed gel pack. Synthetic rubber foam ($R=3\ F°\cdot ft^2\cdot hr\cdot BTU^{-1}$) was used as extra insulation for the frozen items and dry ice. The additional insulation (outer dimensions 9 inches×12 inches×4 inches) covered the bottom face of the transport box, and partially covered four vertical faces of the box with the top surface of the frozen items also closed by a layer of insulation, made of the same synthetic rubber foam material.

No clear temperature indication of when all dry ice sublimed was observed. The temperature of the frozen items gradually rose. In this test, the frozen items remained below 40° F. for 72 hours. The refrigerated items remained between 32° F. and 50° F. for 21 hours. The temperature of the refrigerated items exhibited a continuous rise after the temperature initially surpassed 50° F. due to the absence of PCM. The test results were considered unacceptable as the desired cooling temperature regime of the refrigerated items could not be maintained.

It is quite evident from all of the tests that significant differences in performance can arise by substitution of one refrigeration component of the stacked arrangement with another refrigeration component or by changing location of one or more of the refrigeration components of the stacked arrangement. The present invention, as validated by the tests performed by Applicants, represents a specifically configured two-stage cooling that is capable of independently maintaining different cooling temperature regimes for an extended duration within a single holding volume by having the ability to re-orient itself during transport. The ability for such a transient and improved two stage dry ice system of the present invention to be incorporated into existing containers is a departure from conventional refrigeration techniques that need to rely on specially constructed transport boxes to achieve preservation for a certain duration.

The tests also make clear that the inventive stacked arrangements will provide necessary cooling duration for refrigerated and frozen items in high temperature environments (e.g., the summer months) for the requisite duration.

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. An improved two-stage dry ice system for preserving a first perishable item and a second perishable item during transport of the first perishable item and the second perishable item, said improved two-stage dry ice system, comprising:

a transportable container with a holding volume defined by a first region and a second region, said first region containing the first perishable item and maintaining the first perishable item at a first cooling temperature regime, said second region containing the second perishable item and maintaining the second perishable item at a second cooling temperature regime;

a phase change material (PCM) in close proximity or direct contact to the first perishable item, the PCM disposed within the first region of the holding volume prior to transport;

dry ice in close proximity or direct contact with the second perishable item, said dry ice disposed within the second region of the holding volume prior to transport;

insulative material configured to partially encapsulate the second perishable item during transport of the transportable container;

wherein the PCM and the dry ice form a substantially stacked arrangement with the first perishable item and the second perishable item, said PCM configured to interact with the dry ice in the stacked arrangement whereby the dry ice serves as a first primary refrigerant to maintain the first cooling temperature regime and the second cooling temperature regime during an initial duration of the transport of the transportable container, subsequently followed by the PCM acting as a second primary refrigerant to maintain the first cooling temperature regime and the second cooling temperature regime during a final duration of the transport of the transportable container.

2. The improved two-stage dry ice system of claim 1, wherein the PCM is at least partially liquid.

3. The improved two-stage dry system of claim 2, wherein the PCM comprises substantially water.

4. The improved two-stage dry system of claim 3, wherein the water is in a temperature range of 32° F. to 75° F.

5. The improved two-stage system of claim 4, wherein the water is confined in one or more gel packs.

6. The improved two-stage dry system of claim 5, wherein the water is at approximately 32° F. in a partially or fully thawed state.

7. The improved two-stage dry ice system of claim 1, wherein the system comprises a ratio of weight of the PCM to weight of the dry ice greater than about 0.1 and less than 5.

8. The improved two-stage dry ice system of claim 1, wherein the system comprises a ratio of weight of the PCM to weight of the dry ice greater than about 0.5 and less than about 1.1.

9. The improved two-stage dry ice system of claim 1, wherein the system comprises a ratio of weight of the PCM to weight of the dry ice greater than about 1.1 and less than about 1.6.

10. The improved two-stage dry ice system of claim 1, wherein the holding volume is defined by an absence of a functional partition or a functional compartment.

11. The improved two-stage dry ice system of claim 1, wherein the PCM is a water gel pack that is in a partially or fully frozen state during the initial duration of the transport.

12. The improved two-stage dry ice system of claim 1, wherein the second region during the final duration of the transport is characterized by the PCM in close proximity or direct contact to the second perishable item.

13. The improved two-stage dry ice system of claim 1, wherein the second perishable item is substantially encapsulated by the insulative material and the PCM.

14. The improved two-stage dry ice system of claim 1, wherein the first cooling temperature regime is between 32° F. to 60° F. and the second cooling temperature regime is below 50° F.

15. The improved two-stage dry ice system of claim 1, wherein the second perishable item has a first surface in direct contact or close proximity with the PCM, and the second perishable item has a second surface in direct contact or close proximity with the dry ice during the initial duration of the transport.

16. The improved two-stage dry ice system of claim 1, wherein the second perishable item has a first surface in direct contact or close proximity with the PCM, and the second perishable item has a second surface in direct contact or close proximity with the insulative layer.

17. The improved two-stage dry ice system of claim 1, wherein the second region upon completion of the initial duration of the transport has a residual amount of the dry ice remaining.

18. The improved two-stage dry ice system of claim 1, wherein the PCM is in direct contact or close proximity with the dry ice.

19. The improved two-stage dry ice system of claim 1, wherein a difference between the first cooling temperature regime and the second cooling temperature regime is approximately 0° F.

20. The improved two-stage dry ice system of claim 1, wherein a difference between the first cooling temperature regime and the second cooling temperature regime is approximately 4° F. or greater.

21. An improved two-stage dry ice system for preserving a first perishable item and a second perishable item during transport of the first perishable item and the second perishable item, said improved two-stage dry ice system, comprising:

a transportable container with a holding volume defined by a first region and a second region, said first region containing the first perishable item and maintaining the first perishable item at a first cooling temperature regime, said second region containing the second perishable item and maintaining the second perishable item at a second cooling temperature regime, the holding volume further defined by an absence of partitions or compartments therewithin;

one or more gel packs (GPs) substantially comprised of water in a partially or fully thawed state in close proximity or direct contact to the first perishable item, the one or more GPs disposed within the first region of the holding volume prior to transport;

dry ice in close proximity or direct contact with the second perishable item, said dry ice disposed within the second region of the holding volume prior to transport and during an initial duration of the transport;

insulative material configured to extend along a portion of the second perishable item;

wherein the GP and the dry ice form a substantially stacked arrangement with the first perishable item and the second perishable item.

22. The improved two-stage dry ice system of claim 21, said GP configured to interact with the dry ice in the stacked arrangement whereby the dry ice serves as a first primary refrigerant to provide a requisite cooling to preserve the first and the second perishables during the initial duration of the transport of the transportable container, subsequently followed by the GP serving as a second primary refrigerant to provide the requisite cooling to preserve the first and the second perishables during the initial duration of the transport of the transportable container during a final duration of the transport of the transportable container.

23. The improved two-stage dry ice system of claim 22, wherein the GP transitions from a partially or fully thawed state to a partially or fully frozen state during the initial duration of the transport of the transportable container.

24. The improved two-stage dry ice system of claim 23, wherein the GP reverts from the partially or fully frozen state to the partially or fully thawed state to impart cooling to the transportable container during the final duration of the transport of the transportable container.

25. The improved two-stage dry ice system of claim 21, wherein the second region during the final duration of the transport is characterized by the GP in a partially or fully thawed state and in direct contact with the second perishable item.

26. A method of constructing a two-staged dry ice system for preserving a first perishable item in a first region of a holding volume at a first temperature regime and a second perishable item in a second region of the holding volume at a second temperature regime lower than the first temperature regime for an extended duration in comparison to conventional refrigeration techniques, comprising:

selecting dry ice with a predetermined weight and density, said predetermined weight greater than a lower limit so as to achieve the extended duration but no greater than an upper limit that imparts excess cooling to the first perishable item so as to attain a temperature below the first temperature regime;

selecting one or more gel packs (GPs) substantially comprised of water in a partially or fully thawed state with a total predetermined weight;

loading and stacking the first perishable item to be in close proximity or direct contact with the one or more GPs within the holding volume so as to create the first region;

loading and stacking the second perishable item in close proximity or direct contact with the dry ice within the holding volume so as to create the second region adjacent to the first region;

wherein the dry ice and said one or more GPs are configured in a stacked arrangement whereby the dry ice serves as a first primary refrigerant to provide a requisite cooling to preserve the first and the second perishables during the initial duration of the transport of the transportable container as the one or more GPs protects the first perishable item from falling below the first temperature regime and thereby damaging the first perishable item, subsequently followed by the one or more GPs serving as a second primary refrigerant to provide the requisite cooling to preserve the first and the second perishables during a final duration of the transport of the transportable container.

27. A method of preserving a first perishable item in a first region of a holding volume at a first temperature and a second perishable item in a second region of the holding volume at a second temperature lower than the first temperature for an extended duration in comparison to conventional refrigeration techniques, comprising:

initiating a first stage of cooling by imparting a necessary amount of first-stage refrigeration to each of the first perishable item and the second perishable item from a dry ice source that is in close proximity or direct contact to the second perishable item;

storing and suppressing the amount of refrigeration imparted from the dry ice source to the first perishable during the first stage of cooling so as to prevent damage to the first perishable items using one or more gel packs (GPs) substantially comprised of water in a partially or fully thawed state that are in close proximity or direct contact to the first perishable item;

partially or completely freezing the GPs during the first stage refrigeration to create a partially or fully frozen GPs with sufficient refrigeration capacity;

vaporizing substantially all of the dry ice within the holding volume; and shifting from the first stage of cooling to a second stage of cooling by imparting a necessary amount of a second-stage refrigeration to each of the first perishable item and the second perishable item provided from the partially or fully frozen GPs.

28. The method of claim 27, further comprising the step of minimizing heat leaks into the holding volume by insulating a portion of the second perishable item while keeping exposed the surface of the perishable item oriented towards the first region.

29. The method of claim 27, wherein the necessary amount of refrigeration is greater than a lower limit to achieve the extended duration but not greater than an upper limit that imparts excess cooling to the first perishable item to attain a temperature below the first temperature.

30. The method of claim 27, further comprising the step of at least partially encapsulating the second perishable item within the second stage region and an insulative material after vaporizing all of the dry ice within the holding volume.

31. An improved two-stage dry ice system for preserving a first perishable item during transport of the first perishable item, said improved two-stage dry ice system, comprising:

a transportable container with a holding volume, said holding volume containing the first perishable and maintaining the first perishable item at a first cooling temperature regime;

a phase change material (PCM) in the holding volume, said PCM between a first surface of the first perishable item and a second surface of a predetermined amount of dry ice, said dry ice at a lower temperature than the PCM;

wherein the PCM and the dry ice form a substantially stacked arrangement with the first perishable item, said PCM configured to interact with the dry ice in the stacked arrangement whereby the dry ice serves as a first primary refrigerant to maintain the first cooling temperature regime during an initial duration of the transport of the transportable container, subsequently followed by the PCM serving as a second primary refrigerant for maintaining the first cooling temperature regime during a final duration of the transport of the transportable container.

32. The improved two-stage dry ice system of claim 31, further comprising insulative material extending along a portion of the dry ice.

33. The improved two-stage dry ice system of claim 31, wherein the holding volume is defined by an absence of a functional partition or a functional compartment.

* * * * *